US008794578B2

(12) United States Patent
Lin et al.

(10) Patent No.: US 8,794,578 B2
(45) Date of Patent: Aug. 5, 2014

(54) ADJUSTING MECHANISM FOR ADJUSTING ROTARY ANGLE AND ANTENNA SYSTEM THEREWITH

(75) Inventors: Hung-Yuan Lin, Hsinchu (TW); San-Yi Kuo, Hsinchu (TW); Lan-Chun Yang, Hsinchu (TW); Ming-Chan Lee, Hsinchu (TW); Wei-Te Chien, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 112 days.

(21) Appl. No.: 13/094,844

(22) Filed: Apr. 27, 2011

(65) Prior Publication Data

US 2012/0211624 A1 Aug. 23, 2012

(30) Foreign Application Priority Data

Feb. 23, 2011 (TW) ..... 100105960 A

(51) Int. Cl.

| | |
|---|---|
| ***A47B 96/06*** | (2006.01) |
| ***A47G 29/00*** | (2006.01) |
| ***A47K 1/00*** | (2006.01) |
| ***E04G 3/00*** | (2006.01) |
| ***E04G 5/06*** | (2006.01) |
| ***F21V 21/00*** | (2006.01) |
| ***F21V 35/00*** | (2006.01) |
| ***H01Q 1/12*** | (2006.01) |
| ***H01Q 3/02*** | (2006.01) |

(52) U.S. Cl.

CPC ..... *H01Q 1/1228* (2013.01); *H01Q 1/125* (2013.01); *H01Q 3/02* (2013.01)

USPC ..... 248/218.4; 343/878; 343/880; 343/890

(58) Field of Classification Search

CPC ..... H01Q 1/125; H01Q 3/02; H01Q 1/1228

USPC ..... 248/205.1, 218.4, 222.51, 122.1, 371, 248/372.1, 419, 284.1, 291.1, 292.11, 248/292.13; 343/878, 880, 882, 892, 765, 343/757

See application file for complete search history.

(56) References Cited

U.S. PATENT DOCUMENTS

| | | | | |
|---|---|---|---|---|
| 4,819,006 | A * | 4/1989 | Whitesides et al. | 343/880 |
| 5,941,497 | A * | 8/1999 | Inoue et al. | 248/514 |
| 5,969,692 | A * | 10/1999 | Ishizuka | 343/840 |
| 5,971,345 | A * | 10/1999 | Khalaf | 248/512 |
| 6,031,508 | A * | 2/2000 | Ishizuka et al. | 343/882 |
| 6,222,504 | B1 * | 4/2001 | Oby | 343/892 |
| 6,232,928 | B1 * | 5/2001 | Zimmerman et al. | 343/882 |
| 6,456,258 | B1 * | 9/2002 | Bragg et al. | 343/892 |

(Continued)

*Primary Examiner* — Nkeisha Smith

(74) *Attorney, Agent, or Firm* — Winston Hsu; Scott Margo

(57) ABSTRACT

An adjusting mechanism for adjusting rotary angle is disclosed in the present invention. The adjusting mechanism includes a bracket. The bracket includes a base, a first supporting portion disposed on a first lateral side of the base, and a second supporting portion disposed on a second lateral side of the base. A pivot hole is formed on the first supporting portion. The adjusting mechanism further includes a clamp disposed by a side of the base and located in a position corresponding to the first and the second supporting portion. The adjusting mechanism further includes at least one bridging component connecting to a lateral surface of the clamp, and a pivoting component. A pivot hole is formed on the bridging component. The pivoting component passes through the pivot holes on the first supporting portion and the bridging component, so as to pivot the first supporting portion relative to the bridging component.

18 Claims, 5 Drawing Sheets

(56) References Cited

U.S. PATENT DOCUMENTS

| | | | | |
|---|---|---|---|---|
| 6,535,177 | B1 * | 3/2003 | Dhellemmes et al. | 343/882 |
| 6,657,598 | B2 * | 12/2003 | Tulloch | 343/765 |
| 6,664,937 | B2 * | 12/2003 | Vermette et al. | 343/892 |
| 6,739,561 | B2 * | 5/2004 | Herzog | 248/218.4 |
| 6,864,855 | B1 * | 3/2005 | Fujita | 343/882 |
| 7,046,210 | B1 * | 5/2006 | Brooker et al. | 343/880 |
| 7,050,012 | B2 * | 5/2006 | Chen | 343/757 |
| 7,113,144 | B2 * | 9/2006 | Lin et al. | 343/880 |
| 7,164,391 | B2 * | 1/2007 | Lin et al. | 343/882 |
| 7,374,137 | B2 * | 5/2008 | Staney | 248/122.1 |
| 7,385,564 | B2 * | 6/2008 | Zihlman | 343/878 |
| 7,439,930 | B2 * | 10/2008 | Bury | 343/878 |
| 7,883,065 | B2 * | 2/2011 | Nelson | 248/201 |
| 7,954,777 | B2 * | 6/2011 | Bohm et al. | 248/278.1 |
| 8,020,824 | B2 * | 9/2011 | Pan | 248/299.1 |
| 8,052,107 | B2 * | 11/2011 | Yang et al. | 248/201 |
| 2002/0196195 | A1 * | 12/2002 | Vermette et al. | 343/882 |
| 2004/0169114 | A1 * | 9/2004 | Dierkes | 248/165 |
| 2005/0056743 | A1 * | 3/2005 | Ware et al. | 248/218.4 |
| 2009/0061761 | A1 * | 3/2009 | Yang et al. | 455/3.02 |
| 2009/0267860 | A1 * | 10/2009 | Peng | 343/878 |
| 2010/0259462 | A1 * | 10/2010 | Yeh | 343/882 |
| 2010/0309090 | A1 * | 12/2010 | Grice et al. | 343/882 |
| 2010/0314514 | A1 * | 12/2010 | Nelson | 248/219.1 |
| 2011/0193764 | A1 * | 8/2011 | Shen | 343/882 |
| 2012/0212393 | A1 * | 8/2012 | Lee et al. | 343/880 |

* cited by examiner

ADJUSTING MECHANISM FOR ADJUSTING ROTARY ANGLE AND ANTENNA SYSTEM THEREWITH

BACKGROUND OF THE INVENTION

1. Field of the Invention

The present invention relates to an adjusting mechanism for adjusting rotary angle, and more particularly, to an adjusting mechanism for adjusting rotary angle of an antenna module and a related antenna system.

2. Description of the Prior Art

For receiving signals generated by a satellite effectively, an antenna module includes an adjusting mechanism for adjusting rotary angle of the antenna module according to a position of the satellite relative to the ground. A conventional adjusting mechanism for adjusting an elevation and an azimuth of the antenna module relative to the satellite includes a sheath and a rotating structure. The sheath sheathes on a supporting tube, and the rotating structure is disposed on an end of the sheath (for example, the rotating structure is disposed on top of the sheath), so that the conventional adjusting mechanism can adjust the elevation and the azimuth of the antenna module relative to the supporting tube and the satellite. However, volume of the conventional adjusting mechanism is huge, so that the conventional adjusting mechanism has drawbacks of expensive cost and complicated assembly. Thus, design of an adjusting mechanism of simple structure having low transportation cost and low manufacturing cost is an important issue of the antenna industry.

SUMMARY OF THE INVENTION

The present invention provides an adjusting mechanism for adjusting rotary angle of an antenna module and a related antenna system for solving above drawbacks.

According to the claimed invention, an adjusting mechanism includes a bracket. The bracket includes a base, a first supporting portion disposed on a first lateral side of the base, and a second supporting portion disposed on a second lateral side of the base. The pivot hole is formed on the first supporting portion. The adjusting mechanism further includes a clamp disposed by a side of the base and located in a position corresponding to the first supporting portion and the second supporting portion for clamping a supporting tube, and at least one bridging component connecting to a lateral surface of the clamp. A pivot hole is formed on the bridging component. The adjusting mechanism further includes a pivoting component passing through the pivot hole on the first supporting portion and the pivot hole on the bridging component so that the first supporting portion pivots relative to the bridging component. An aim of the adjusting mechanism is that the antenna module can pivot relative to the supporting tube via the clamp within great range, and can further pivot along the pivot hole on the bridging component within tiny range after the clamp is fixed on the supporting tube by a fixing component set.

According to the claimed invention, the first lateral side and the second lateral side are two opposite lateral sides of the base.

According to the claimed invention, the adjusting mechanism further includes a fine tuning screw module, two ends of the fine tuning screw module being respectively disposed on the bridging component and the first supporting portion.

According to the claimed invention, the fine tuning screw module includes two locking component sets, and a screw rod passing through the two locking component sets for adjusting a distance between the two locking component sets so as to pivot the first supporting portion relative to the bridging component. The two locking component sets are respectively installed on the bridging component and the first supporting portion.

According to the claimed invention, each locking component set includes a nut and a screw having a side hole. The screw passes through the bridging component or through the first supporting portion and locking on the nut.

According to the claimed invention, a slide slot is formed on the first supporting portion, and the adjusting mechanism further comprises a guiding component passing through the slide slot and disposed on the bridging component for guiding the first supporting portion to pivot relative to the bridging component.

According to the claimed invention, the adjusting mechanism includes a plurality of bridging components respectively connecting to the lateral surface of the clamp facing the first supporting portion and the second supporting portion. A pivot hole is formed on each bridging component. The adjusting mechanism further includes two pivoting components respectively passing through the pivot holes on the first supporting portion, the second supporting portion and the plurality of bridging components, so that the first supporting portion and the second supporting portion pivot relative to the plurality of bridging components.

According to the claimed invention, a slide slot is formed on the second supporting portion, and the adjusting mechanism further comprises a guiding component passing through the slide slot and disposed on the bridging component pivoting to the second supporting portion for guiding the second supporting portion to pivot relative to the corresponding bridging component.

According to the claimed invention, the bracket further includes a third supporting portion and a fourth supporting portion. The clamp is located between the third supporting portion and the fourth supporting portion.

According to the claimed invention, the adjusting mechanism further includes a supporter pivoting to the third supporting portion and the fourth supporting portion for supporting an antenna module, and a fine tuning screw module disposed between the supporter and the third supporting portion for adjusting an angle between the supporter and the bracket.

According to the claimed invention, an antenna system includes a supporting tube, an antenna module, and an adjusting mechanism installed on the supporting tube and connected to the antenna module for adjusting an angle between the antenna module and the supporting tube. The adjusting mechanism includes a bracket. The bracket includes a base, a first supporting portion disposed on a first lateral side of the base, and a second supporting portion disposed on a second lateral side of the base. The pivot hole is formed on the first supporting portion. The adjusting mechanism further includes a clamp disposed by a side of the base and located in a position corresponding to the first supporting portion and the second supporting portion for clamping a supporting tube, and at least one bridging component connecting to a lateral surface of the clamp. A pivot hole is formed on the bridging component. The adjusting mechanism further includes a pivoting component passing through the pivot hole on the first supporting portion and the pivot hole on the bridging component so that the first supporting portion pivots relative to the bridging component. An aim of the adjusting mechanism is that the antenna module can pivot relative to the supporting tube via the clamp within great range, and can further pivot along the pivot hole on the bridging component within tiny range after the clamp is fixed on the supporting tube by a fixing component set.

The bracket of the adjusting mechanism of the present invention includes the base and the four supporting portions. The four supporting portions are respectively disposed on four lateral sides of the base, which means the bracket can be a U-shaped structure, and the U-shaped structure can be connected to the lateral surface of the clamp via the bridging component for minimizing the volume of the adjusting mechanism. It should be mentioned that the structure of the bracket is not limited to the U-shaped structure of the above-mentioned embodiment. For example, the bracket can be a square structure or a polygon structure. The present invention improves connection between the bracket and the clamp, so that the angle of the antenna module relative to the supporting tube (the elevation and the azimuth) can be adjusted as the volume of the adjusting mechanism is minimized. Therefore, the adjusting mechanism of the present invention has advantages of easy assembly and easy operation, and manufacturing cost and transportation cost of the adjusting mechanism are decreased effectively.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
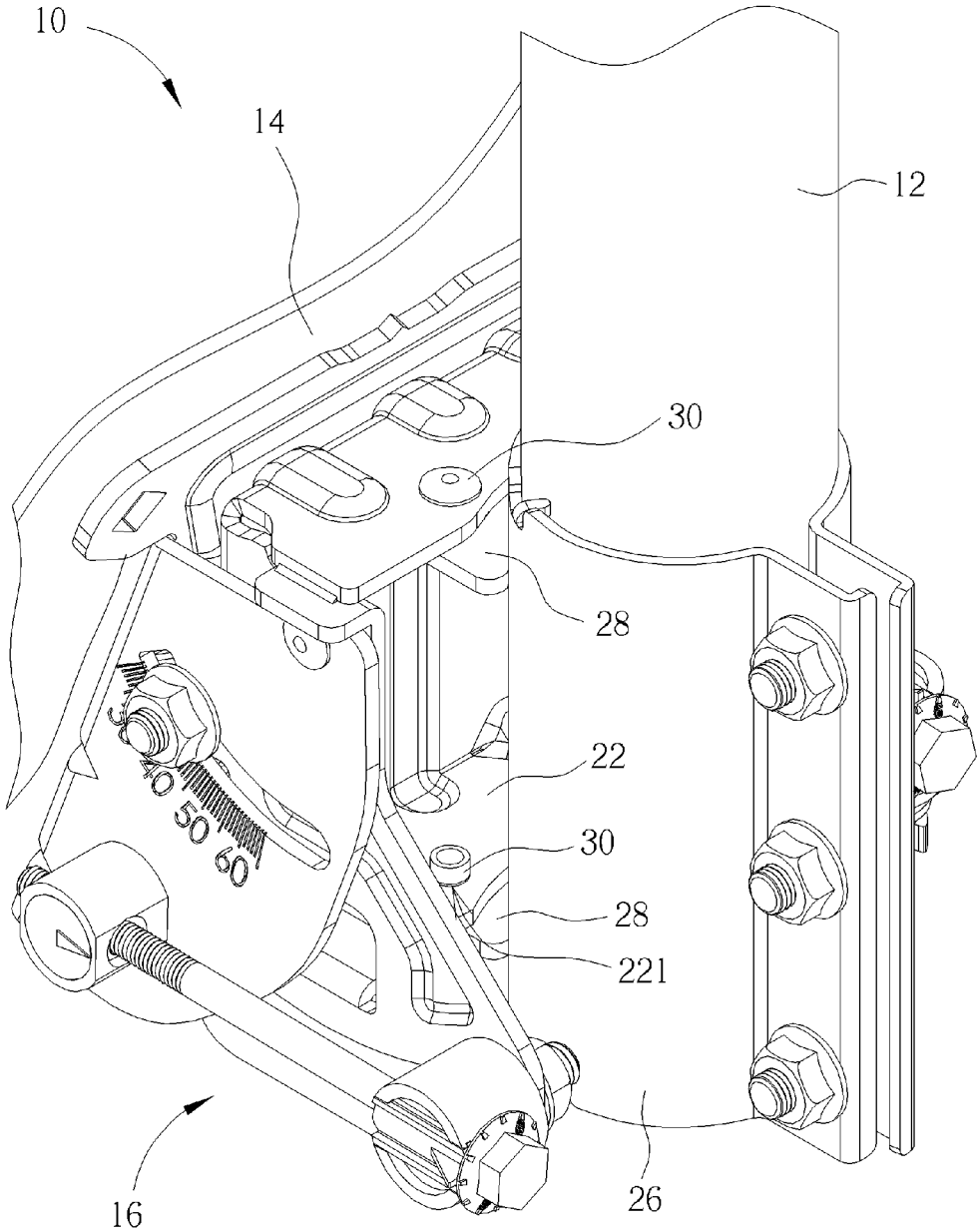
FIG. 1 and FIG. 2 are diagrams of an antenna system in different view angles according to an embodiment of the present invention.
Figure 2:
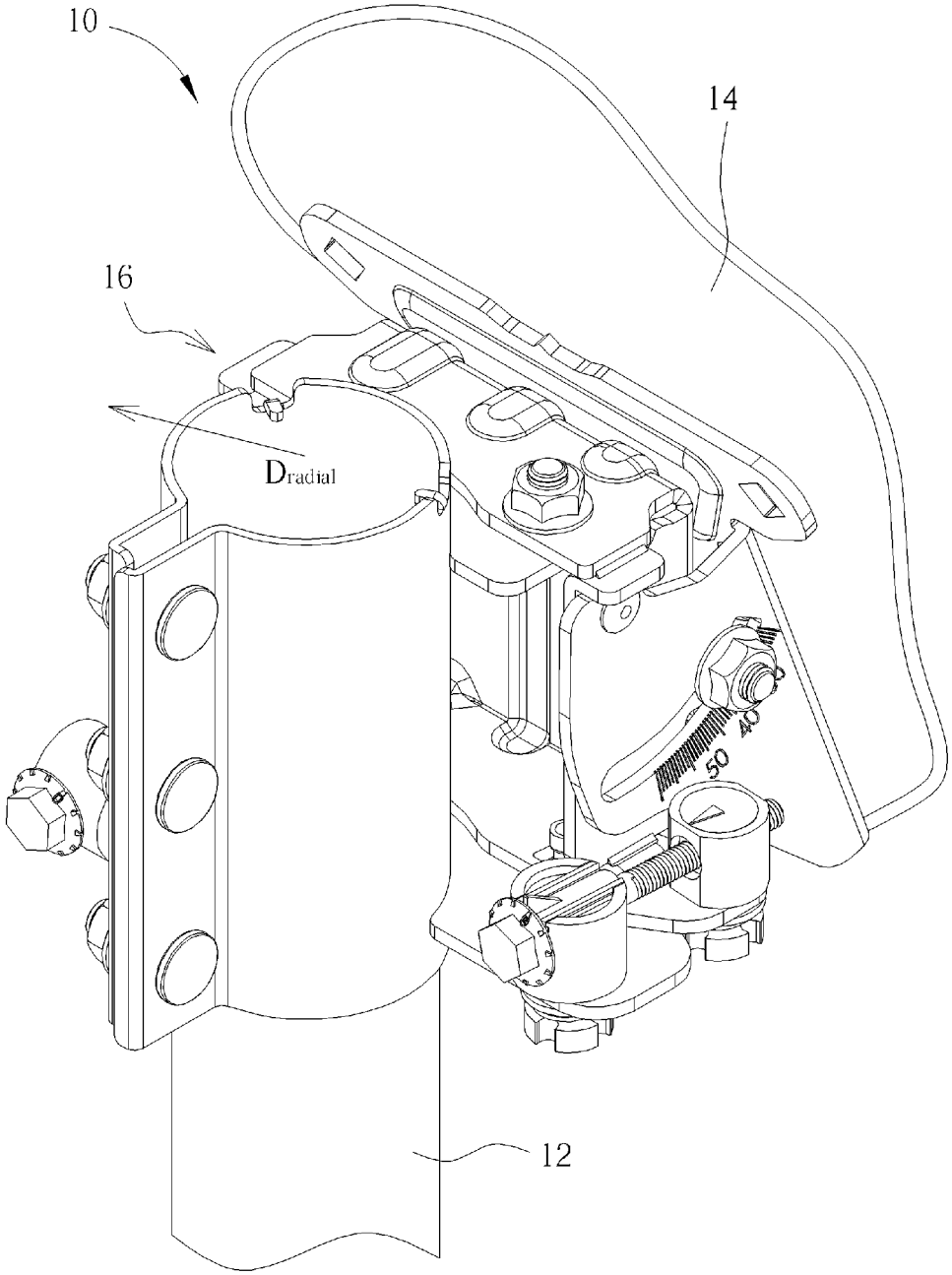

Please refer to FIG. 1 and FIG. 2. FIG. 1 and FIG. 2 are diagrams of an antenna system 10 in different view angles according to an embodiment of the present invention. The antenna system 10 includes a supporting tube 12, an antenna module 14 and an adjusting mechanism 16. The adjusting mechanism 16 is installed on the supporting tube 12 and connected to the antenna module 14, so as to adjust an angle of the antenna module 14 relative to the supporting tube 12 for directionally aligning toward a satellite. In this embodiment, the adjusting mechanism 16 is for adjusting an azimuth and an elevation of the antenna module 14 relative to the supporting tube 12 and the satellite.

Figure 3:
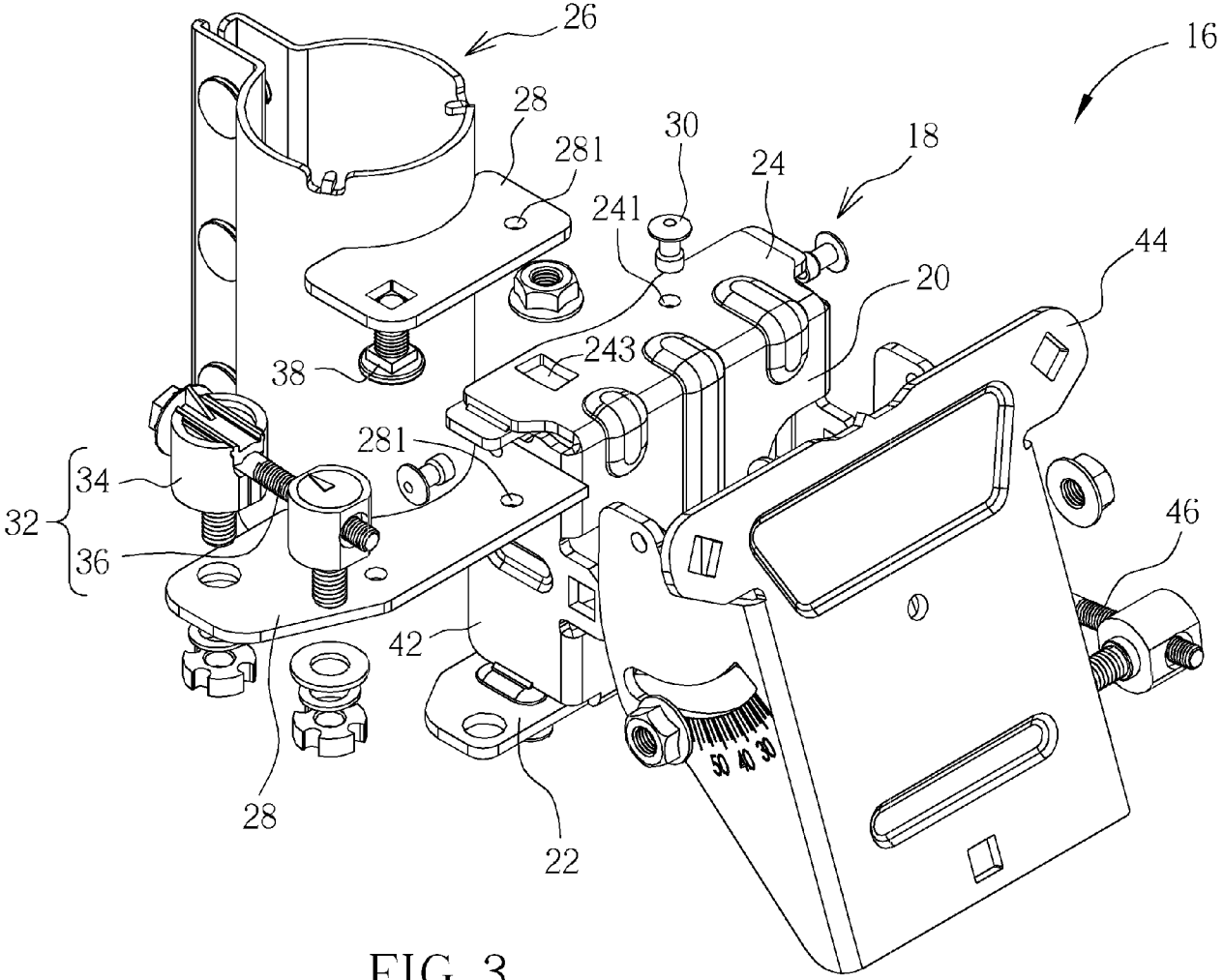
FIG. 3 to FIG. 5 are exploded diagrams of an adjusting mechanism in different view angles according to the embodiment of the present invention.
Figure 4:
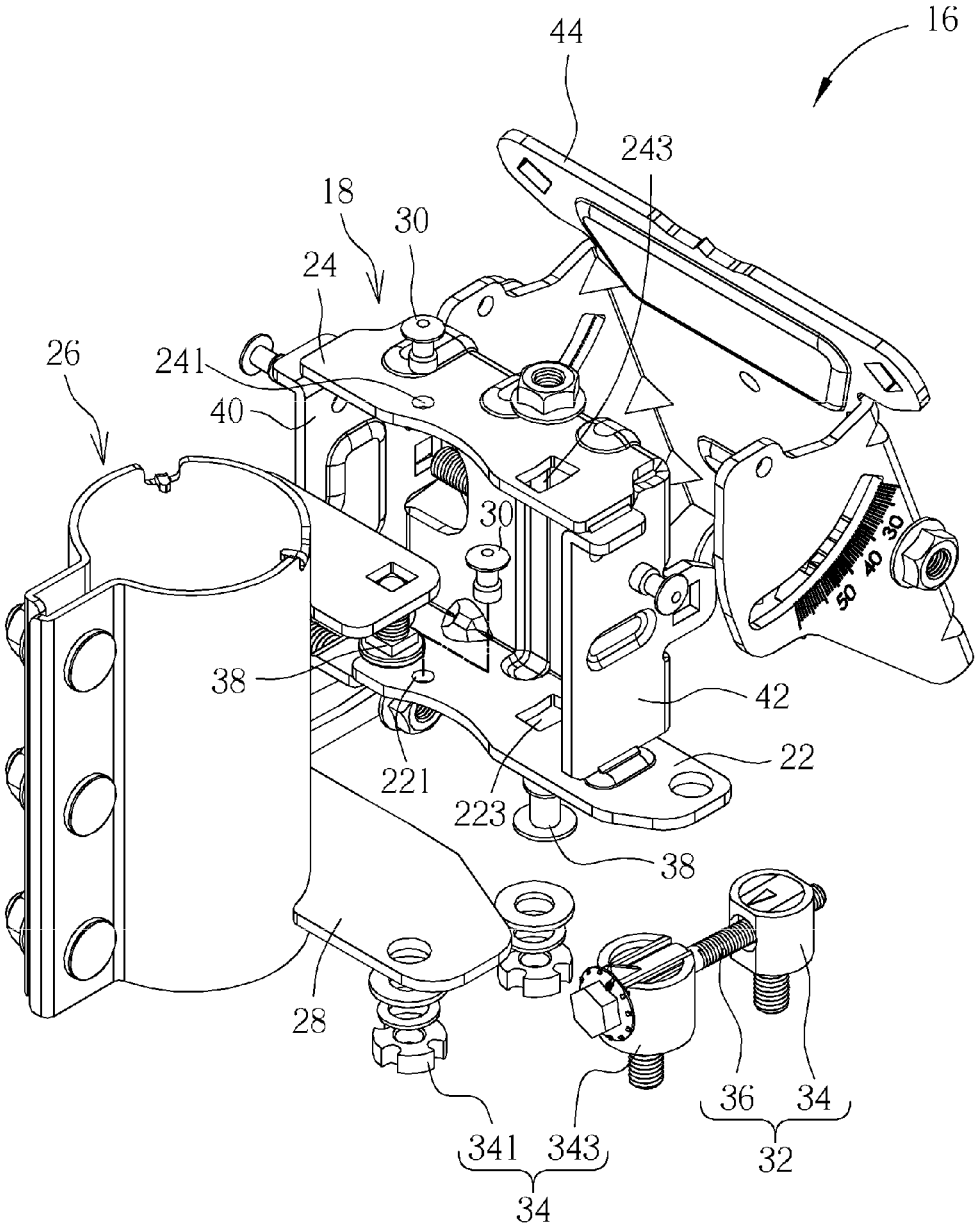
Figure 5:
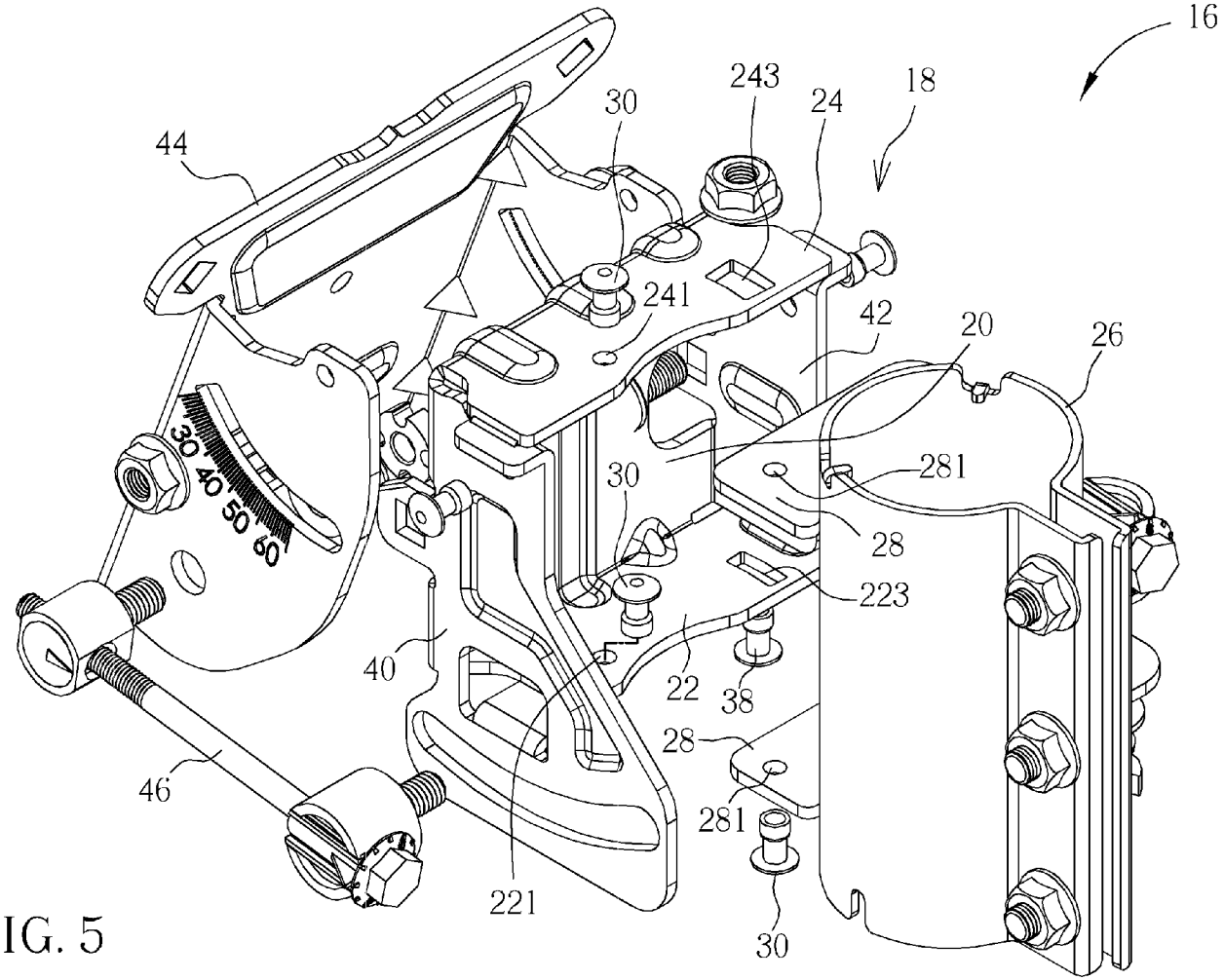

Please refer to FIG. 3 to FIG. 5. FIG. 3 to FIG. 5 are exploded diagrams of the adjusting mechanism 16 in different view angles according to the embodiment of the present invention. The adjusting mechanism 16 includes a bracket 18. The bracket 18 includes a base 20, a first supporting portion 22 disposed on a first lateral side of the base 20, and a second supporting portion 24 disposed on a second lateral side of the base 20. The first supporting portion 22 and the second supporting portion 24 are respectively disposed on two opposite lateral sides of the base 20 (such as an upper side and a low side), and a pivot hole 221 is formed on the first supporting portion 22. The adjusting mechanism 16 further includes a clamp 26 disposed by a side of the base 20 and located in a position corresponding to the first supporting portion 22 and the second supporting portion 24, and at least one bridging component 28 connecting to a lateral surface of the clamp 26. The clamp 26 is connected to the first supporting portion 22 of the bracket 18 via the bridging component 28. A pivot hole 281 is formed on the bridging component 28. The adjusting mechanism 16 further includes a pivoting component 30 passing through the pivot hole 221 on the first supporting portion 22 and the pivot hole 281 on the bridging component 28, so that the first supporting portion 22 can pivot relative to the bridging component 28. In addition, the clamp 26 is for clamping the supporting tube 12, so as to install the adjusting mechanism 16 on the supporting tube 12. Volume of the adjusting mechanism 16 is minimized because the clamp 26 is disposed by a side of the bracket 18.

The adjusting mechanism 16 can further include a fine tuning screw module 32. Two ends of the fine tuning screw module 32 are respectively disposed on the bridging component 28 and the first supporting portion 22. The fine tuning screw module 32 can include two locking component sets 34 and a screw rod 36. Each locking component set 34 can include a nut 341 and a screw 343 having a side hole. The screw 343 passes through the bridging component 28 (or the first supporting portion 22) and is locked on the nut 341, and the screw rod 36 passes through the screw 343 of the locking component set 34. The screw rod 36 can be rotated to move one of the locking component sets 34 toward the other of the locking component sets 34 along a thread on the screw rod 36, so as to adjust a distance between the two locking component sets 34 for pivoting the first supporting portion 22 relative to the bridging component 28. In addition, a slide slot 223 can be formed on the first supporting portion 22, the adjusting mechanism 16 can further include a guiding component 38 passing through the slide slot 223 and disposed on the bridging component 28, so as to guide the first supporting portion 22 to pivot relative to the bridging component 28 along a track on the slide slot 223.

For strengthening structural intensity of the adjusting mechanism 16, as shown in FIG.3 to FIG.5, the adjusting mechanism 16 can include two bridging components 28. The two bridging components 28 are respectively connected to the lateral surface of the clamp 26 facing the first supporting portion 22 and the second supporting portion 24. The two bridging components 28 are arranged along a longitudinal direction of the clamp 26, and the longitudinal direction is substantially perpendicular to a radial plane $D_{radial}$ of the clamp 26. Structures and functions of the two bridging components 28 can be identical. For example, the pivot holes 281 are respectively formed on the two bridging components 28. In addition, the adjusting mechanism 16 can further include two pivoting components 30 having the same structures and functions. The two pivoting components 30 respectively pass through the pivot hole 221 on the first supporting portion 22, a pivot hole 241 on the second supporting portion 24, and the pivot hole 281 on the corresponding bridging component 28, so that the first supporting portion 22 and the second supporting portion 24 can pivot relative to the corresponding bridging components 28. Besides, a slide slot 243 can be formed on the second supporting portion 24, thus the adjusting mechanism 16 can include two guiding components 38 correspondingly. The two guiding components 38 can respectively pass through the slide slot 223 on the first supporting portion 22 and the slide slot 243 on the second supporting portion 24, and can be respectively disposed on the corresponding bridging components 28 pivoting to the first supporting portion 22 and the second supporting portion 24, so as to guide the first supporting portion 22 and the second supporting portion 24 to pivot relative to the two bridging components 28 along the track on the slide slots 223, 243. Therefore, the azimuth of the antenna module 14 relative to the supporting tube 12 can be adjusted accurately.

The adjusting mechanism 16 is connected to the antenna module 14, and pivots the antenna module 14 relative to the clamp 26 along a horizontal plane via the first supporting portion 22 and the second supporting portion 24 of the bracket 18 and the bridging component 28. Furthermore, the bracket 18 can further include a third supporting portion 40 and a fourth supporting portion 42. The third supporting portion 40 and the fourth supporting portion 42 can respectively be disposed on a left side and a right side of the base 20, and the clamp 26 can be disposed by the base 20 and be located between the third supporting portion 40 and the fourth supporting portion 42. The adjusting mechanism 16 can further includes a supporter 44 pivoting to the third supporting portion 40 and the fourth supporting portion 42. As shown in FIG. 1 to FIG. 5, the supporter 44 supports the antenna module 14, so that the antenna module 14 can pivot relative to the bracket 18 upwards and downwards via the supporter 44 and the third supporting portion 40 and the fourth supporting portion 42 of the bracket 18, which means the elevation of the antenna module 14 relative to the supporting tube 12 can be adjusted. The adjusting mechanism 16 can further include a fine tuning screw module 46 disposed between the supporter 44 and the third supporting portion 40 (or the fourth supporting portion 42). Structure and functions of components of the fine tuning screw module 46 are identical with the fine tuning screw module 32, and detailed description is omitted herein for simplicity. The fine tuning screw module 46 is for adjusting an elevation of the supporter 44 relative to the bracket 18.

Comparing to the prior art, the adjusting mechanism of the present invention can adjust the azimuth and the elevation of the antenna module relative to the supporting tube. The bracket of the adjusting mechanism of the present invention includes the base and the four supporting portions. The four supporting portions are respectively disposed on four lateral sides of the base, which means the bracket can be a U-shaped structure, and the U-shaped structure can be connected to the lateral surface of the clamp via the bridging component for minimizing the volume of the adjusting mechanism. It should be mentioned that the structure of the bracket is not limited to the U-shaped structure of the above-mentioned embodiment. For example, the bracket can be a square structure or a polygon structure. The present invention improves connection between the bracket and the clamp, so that the angle of the antenna module relative to the supporting tube (the elevation and the azimuth) can be adjusted as the volume of the adjusting mechanism is minimized. Therefore, the adjusting mechanism of the present invention has advantages of easy assembly and easy operation, and manufacturing cost and transportation cost of the adjusting mechanism are decreased effectively.

Those skilled in the art will readily observe that numerous modifications and alterations of the device and method may be made while retaining the teachings of the invention.

What is claimed is:

1. An adjusting mechanism comprising:

a bracket comprising:

a base;

a first supporting portion bent from a first lateral side of the base, a pivot hole being formed on the first supporting portion;

a second supporting portion bent from a second lateral side of the base;

a third supporting portion bent from a lateral side between the first lateral side and the second lateral side of the base; and a fourth supporting portion bent from another lateral side of the base opposite to the third supporting portion, wherein extending directions of the first supporting portion, the second supporting portion, the third supporting portion and the fourth supporting portion relative to the base are identical with one another;

a clamp disposed by a side of the base and located in a position corresponding to the first supporting portion and the second supporting portion for clamping a supporting tube;

two bridging components connecting to a lateral surface of the clamp and arranged along a longitudinal direction of the clamp, a pivot hole being formed on each bridging component, the two bridging components comprising a first bridging component and a second bridging component, wherein the longitudinal direction is substantially perpendicular to a radial plane of the clamp;

at least one pivoting component passing through the pivot hole on the first supporting portion and the pivot hole on the first bridging component so that the first supporting portion pivots relative to the first bridging component, wherein the second bridging component is surrounded by the second supporting portion, the third supporting portion and the fourth supporting portion when the first supporting portion pivots relative to the first bridging component; and a fine tuning screw module, two ends of the fine tuning screw module being respectively disposed on the first bridging component and the first supporting portion.

2. The adjusting mechanism of claim 1, wherein the first lateral side and the second lateral side are two opposite lateral sides of the base.

3. The adjusting mechanism of claim 1, wherein the fine tuning screw module comprises:

two locking component sets, the two locking component sets being respectively installed on the first bridging component and the first supporting portion; and a screw rod passing through the two locking component sets for adjusting a distance between the two locking component sets so as to pivot the first supporting portion relative to the first bridging component.

4. The adjusting mechanism of claim 3, wherein each locking component set comprises:

a nut; and a screw having a side hole, the screw passing through the one of the two bridging components or through the first supporting portion and locking on the nut.

5. The adjusting mechanism of claim 1, wherein a slide slot is formed on the first supporting portion, and the adjusting mechanism further comprises a guiding component passing through the slide slot and disposed on the first bridging component for guiding the first supporting portion to pivot relative to the first bridging component.

6. The adjusting mechanism of claim 1, wherein the two bridging components respectively face the first supporting portion and the second supporting portion, and the adjusting mechanism comprises:

two pivoting components respectively passing through the pivot holes on the first supporting portion, the second supporting portion and the two bridging components so that the first supporting portion and the second supporting portion pivot relative to the two bridging components.

7. The adjusting mechanism of claim 6, wherein a slide slot is formed on the second supporting portion, and the adjusting mechanism further comprises a guiding component passing through the slide slot and disposed on the second bridging component pivoting to the second supporting portion for guiding the second supporting portion to pivot relative to the second bridging component.

8. The adjusting mechanism of claim 1, wherein the clamp is located between the third supporting portion and the fourth supporting portion.

9. The adjusting mechanism of claim 8, further comprising:

a supporter pivoting to the third supporting portion and the fourth supporting portion for supporting an antenna module; and a fine tuning screw module disposed between the supporter and the third supporting portion for adjusting an angle between the supporter and the bracket.

10. An antenna system comprising:

a supporting tube;

an antenna module; and an adjusting mechanism installed on the supporting tube and connected to the antenna module for adjusting an angle between the antenna module and the supporting tube, the adjusting mechanism comprising:

a bracket comprising:

a base;

a first supporting portion bent from a first lateral side of the base, a pivot hole being formed on the first supporting portion;

a second supporting portion bent from a second lateral side of the base;

a third supporting portion bent from a lateral side between the first lateral side and the second lateral side of the base; and a fourth supporting portion bent from another lateral side of the base opposite to the third supporting portion, wherein extending directions of the first supporting portion, the second supporting portion, the third supporting portion and the fourth supporting portion relative to the base are identical with one another;

a clamp disposed by a side of the base and located in a position corresponding to the first supporting portion and the second supporting portion for clamping the supporting tube;

two bridging components connecting to a lateral surface of the clamp and arranged along a longitudinal direction of the clamp, a pivot hole being formed on each bridging component, the two bridging components comprising a first bridging component and a second bridging component, wherein the longitudinal direction is substantially perpendicular to a radial plane of the clamp;

at least one pivoting component passing through the pivot hole on the first supporting portion and the pivot hole on the first bridging component so that the first supporting portion pivots relative to the first bridging component, wherein the second bridging component is surrounded by the second supporting portion, the third supporting portion and the fourth supporting portion when the first supporting portion pivots relative to the first bridging component; and a fine tuning screw module, two ends of the fine tuning screw module being respectively disposed on the first bridging component and the first supporting portion.

11. The antenna system of claim 10, wherein the first lateral side and the second lateral side are two opposite lateral sides of the base.

12. The antenna system of claim 10, wherein the fine tuning module comprises:

two locking component sets, the two locking component sets being respectively installed on the first bridging component and the first supporting portion; and a screw rod passing through the two locking component sets for adjusting a distance between the two locking component sets so as to pivot the first supporting portion relative to the first bridging component.

13. The antenna system of claim 12, wherein each locking component set comprises:

a nut; and a screw having a side hole, the screw passing through the one of the two bridging components or through the first supporting portion and locking on the nut.

14. The antenna system of claim 10, wherein a slide slot is formed on the first supporting portion, and the adjusting mechanism further comprises a guiding component passing through the slide slot and disposed on the first bridging component for guiding the first supporting portion to pivot relative to the first bridging component.

15. The antenna system of claim 10, wherein the two bridging components respectively face the first supporting portion and the second supporting portion, and the adjusting mechanism comprises:

two pivoting components respectively passing through the pivot holes on the first supporting portion, the second supporting portion and the two bridging components so that the first supporting portion and the second supporting portion pivot relative to the two bridging components.

16. The antenna system of claim 15, wherein a slide slot is formed on the second supporting portion, and the adjusting mechanism further comprises a guiding component passing through the slide slot and disposed on the second bridging component pivoting to the second supporting portion for guiding the second supporting portion to pivot relative to the second bridging component.

17. The antenna system of claim 10, wherein the clamp is located between the third supporting portion and the fourth supporting portion.

18. The antenna system of claim 17, wherein the adjusting mechanism further comprises:

a supporter pivoting to the third supporting portion and the fourth supporting portion for supporting the antenna module; and a fine tuning screw module disposed between the supporter and the third supporting portion for adjusting an angle between the supporter and the bracket.

* * * * *